United States Patent [19]

Brand

[11] Patent Number: 4,601,317

[45] Date of Patent: Jul. 22, 1986

[54] VENEER SLICING SYSTEM

[75] Inventor: Robert D. Brand, Lawrence, Ind.

[73] Assignee: Capital Machine Company, Inc., Indianapolis, Ind.

[21] Appl. No.: 697,026

[22] Filed: Jan. 31, 1985

[51] Int. Cl.[4] ..... B27L 5/06

[52] U.S. Cl. ..... 144/178; 144/214

[58] Field of Search ..... 144/178, 162 R, 211-214

[56] References Cited

U.S. PATENT DOCUMENTS

| | | | |
|---|---|---|---|
| 793,306 | 6/1905 | Koss | 144/178 |
| 2,576,520 | 11/1951 | Koss | 144/178 |
| 2,676,627 | 4/1954 | McFall | 144/178 |
| 3,441,069 | 4/1969 | Koss | 144/178 |
| 3,654,973 | 4/1972 | Koss | 144/178 |
| 4,068,693 | 1/1978 | Cremona | 144/178 |
| 4,069,850 | 1/1978 | Cremona | 144/178 |

*Primary Examiner*—W. D. Bray

*Attorney, Agent, or Firm*—Willian Brinks Olds Hofer Gilson & Lione

[57] ABSTRACT

A system permits the apparatus for slicing veneer from a flitch to be initially adjusted and to be operated efficiently and reliably. The system includes an improved pressure plate adjustment means as part of the apparatus, including an electric drive for each end of the pressure plate to quickly and accurately position the pressure plate relative to the edge of the veneer cutting blade. By simply pressing push buttons controlling the two electric drives, each end of the pressure plate can be caused to move forward or backward in precise increments of less than 0.001 inch and to be quickly and accurately vertically aligned with the cutting blade edge. Thereafter, the desired spacing can be set on a control console by means of thumbwheel switches and a computer means will automatically position the pressure plate to achieve the desired spacing. The system further includes a blade advance means which effects both the movement of the cutting blade away from the flitch prior to each return stroke of the flitch table, and toward the flitch table to be positioned for accurate slicing of each layer of veneer during each slicing stroke. The blade advance means includes a separate electric motor drive coupled to the carriage and controlled from the control console from which veneer thickness can also be set. By simply setting the veneer thickness on the console, the electric motor drive will automatically advance the carriage, and the cutting blade supported thereon, forward by the desired distance following each slicing operation to position the blade relative to the flitch for the next slicing operation.

41 Claims, 7 Drawing Figures

FIG. 5
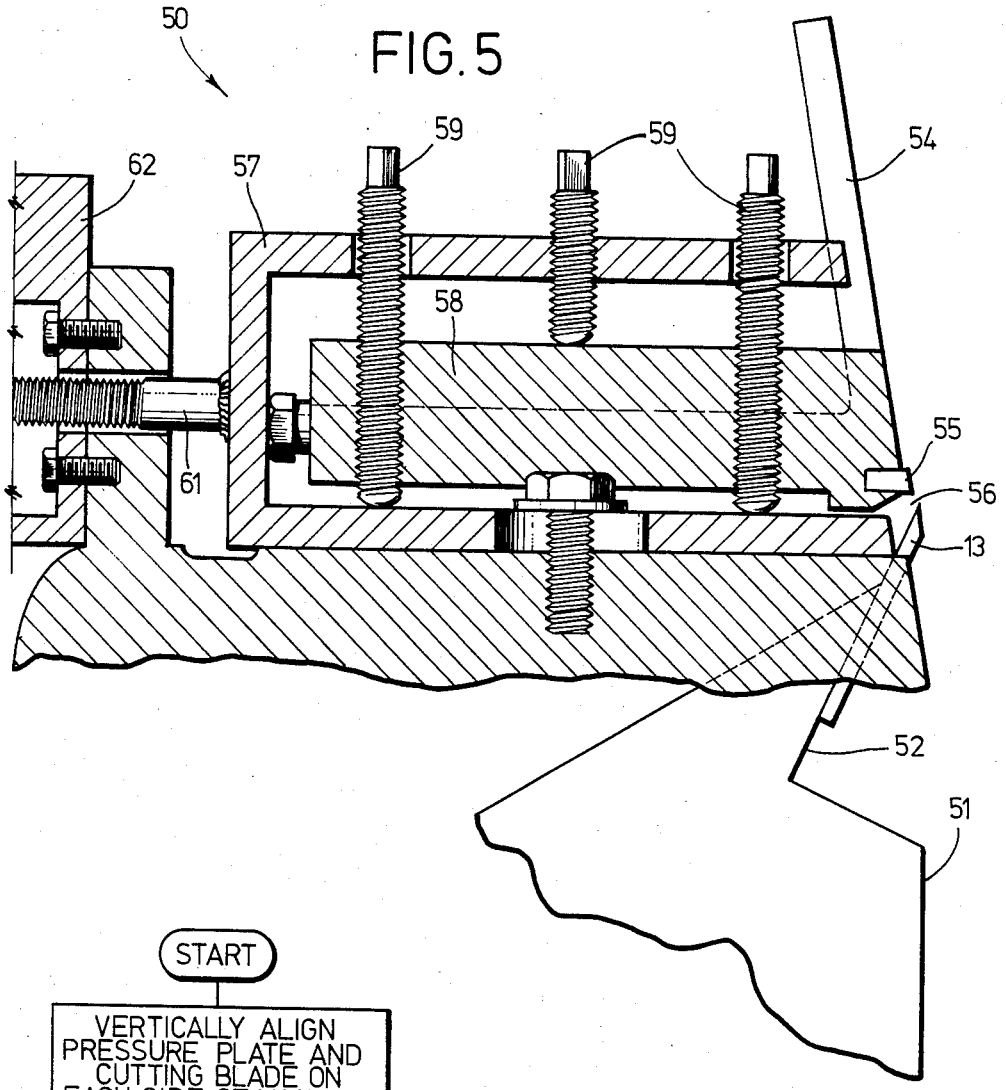
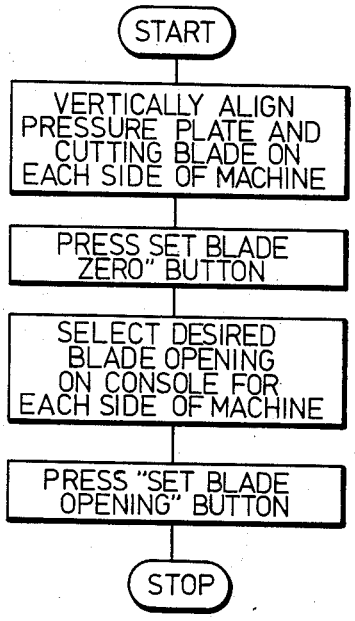
FIG. 7

VENEER SLICING SYSTEM

BACKGROUND OF THE INVENTION

The present invention relates to veneer-slicing apparatus, and, more particularly, to a veneer-slicing apparatus of the type described in U.S. Pat. Nos. 793,306; 2,576,520; and 3,441,069 wherein a log section or flitch is mounted on a reciprocating flitch table adjacent a cutting blade which is positioned to slice a veneer sheet from the flitch during each reciprocation of the flitch table. The cutting blade is mounted on a movable carriage which is indexed forwardly toward the flitch after each reciprocation of the flitch table. The apparatus advances and properly positions the cutting blade relative to the flitch for slicing successive veneer sheets therefrom.

The apparatus described in the above-referenced patents is large and massive. Such apparatus weighs several tons in addition to the flitch weight, and yet must be capable of slicing veneer sheets having a uniform thickness of 0.02 inch or less with accuracy and at a high rate of speed. This requires that the apparatus be accurately adjusted prior to initiation of a slicing operation and that it be precisely controlled during the slicing operation.

For example, one adjustment that must be performed prior to initiation of a slicing operation is to position a pressure plate with respect to the edge of the cutting blade. More specifically, if the apparatus is designed to slice a veneer sheet from the flitch during each downward stroke of the reciprocating flitch table, the pressure plate will be positioned above and behind the edge of the cutting blade to define a narrow space or blade opening between the cutting blade and the pressure plate through which the veneer sheet passes as it is sliced from the flitch. The veneer sheet is then received by a transport assembly which transfers the sheet to a location to be picked up by an operator. The pressure plate provides support for the veneer sheet as it is being sliced; and in order to produce a high-quality sheet of uniform thickness, it must be accurately positioned with respect to the cutting edge of the blade.

The pressure plate is mounted to a pressure plate support means which, in turn, has a large feed screw at each end thereof. In current systems, adjustment of the horizontal position of the plate is accomplished by manually rotating the two screws with a large wrench, causing the ends of the pressure plate support means and the pressure plate mounted thereto to move forward or backward; and an operator must move back and forth from one side of the apparatus to the other, checking the alignment of the pressure plate and blade edge by hand upon each rotation of the screws until he is satisfied that the pressure plate and blade edge are properly positioned relative to one another across the entire several foot length of the blade.

It is difficult to move the pressure plate by the very small and precise amounts needed for accurate positioning. Thus, the procedure tends to be somewhat time consuming and to require an operator of substantial skill.

As indicated above, the cutting blade typically slices a veneer sheet from the flitch during each downward stroke of the flitch table. Following each such stroke, the flitch table must be returned to its uppermost position in preparation for slicing the next sheet from the flitch. In order to insure that the flitch will not contact and possibly damage the cutting blade during the upward movement of the flitch table, it is necessary to move the cutting blade back and out of the way of the flitch. In current systems, this is done by mounting an assembly consisting of the blade holder and pressure plate support member on ball joints for pivotal movement relative to the flitch table. Before each upward stroke of the flitch table, the assembly is caused to pivot back out of the way of the flitch and, thereafter, to pivot back into a vertical position for slicing the next sheet.

The apparatus is designed to slice up to 150 veneer sheets per minute, and the resulting rapid oscillation of the massive pressure plate and cutting blade assembly places a substantial strain on the equipment. Furthermore, it is frequently necessary to change the setting of the blade and pressure plate in changing from one flitch to another, particularly if the flitches are of different woods.

The pressure plate and cutting blade assembly is supported on a movable carriage; and after each sheet is sliced from the flitch, the carriage must be stepped forward to position the blade relative to the flitch for slicing the next sheet. Each step is quite small, e.g., 0.02 inch, and is currently accomplished by a complex system of gears and other mechanical components connected to the drive motor for the reciprocating flitch table.

Frequently, during the operation of the apparatus, it becomes necessary to stop the system for one reason or another. For example, the apparatus might jam; a flitch might fall off of the flitch table; or the flitch may have a nail or other foreign object embedded therein which must be removed to avoid damaging the cutting blade. In such circumstances, the apparatus must be stopped; and the carriage must be moved away from the flitch table for servicing.

After servicing is completed, the carriage must be returned to the correct position to continue the slicing operation; and currently, this is a relatively time-consuming operation which significantly increases the downtime of the apparatus.

SUMMARY OF THE INVENTION

In accordance with the present invention, a veneer-slicing system is provided which permits the apparatus to be initially adjusted and operated more efficiently and reliably than heretofore.

According to one aspect of the invention, an improved pressure plate adjustment means and method is provided to quickly and accurately position the pressure plate relative to the edge of the cutting blade. This pressure plate adjustment means includes two electric drive means coupled to a pair of feed screws by a timing belt reduction coupling. The feed screws are attached to each end of the pressure plate while the electric drive means are each controlled by an electric control operated by a series of push buttons at each end of the pressure plate support means. By simply pressing the push buttons, each end of the pressure plate can be caused to move forward or backward in precise increments of less than 0.0001 inch, thus permitting the pressure plate to be quickly aligned in the same vertical plane as the edge of the cutting blade.

Once aligned in this manner, the desired horizontal spacing between the blade edge and the pressure plate can be achieved by simply setting the desired spacing on a central control console. Computer means incorporated into the system then automatically causes the pressure plate to be moved horizontally to the correct position relative to the blade edge.

According to a further aspect of the invention, the system includes a blade advance means which effects both the movement of the pressure plate and cutting blade assembly back away from the flitch prior to each upward stroke of the flitch table, and the forward stepping movement of the carriage toward the flitch table prior to each successive slicing operation.

The blade advance means includes a separate electric motor drive coupled to the carriage and controlled from the central control console at which veneer thickness can be set by means of thumbwheel controls. By simply setting the veneer thickness on the console, the electric motor drive will automatically step the carriage, and the cutting blade supported thereon, forward by the desired distance following each slicing operation to position the blade relative to the flitch for the next slicing operation. Furthermore, the pressure plate and cutting-blade assembly, rather than being pivoted out of the way of the flitch during each upward stroke of the flitch table, as in current systems, is rigidly mounted to the carriage; and the entire carriage is stepped back to move the blade out of the way.

The computer means incorporated into the veneer slicing system of the present invention comprises a plurality of microprocessors which permit many aspects of the apparatus and its operation to be controlled and monitored from the central console. For example, as indicated above, both the horizontal spacing between the cutting blade and the pressure plate and the thickness of the veneer sheets can be controlled from the central console. Also, the carriage can be caused to move backward or forward at a relatively high rate of speed for servicing and restart of the system, respectively, to reduce machine downtime. In addition, the computer stores data relating to the position of the carriage; and following servicing, for example, the computer will "remember" the position of the carriage when the system was shut down and will automatically return to that position for resumption of the slicing operation.

Further features of the invention will become apparent hereinafter in conjunction with the following detailed description of the preferred embodiment.

BRIEF DESCRIPTION OF THE DRAWINGS

FIG. 5 is a partial cross-sectional view illustrating a portion of the pressure plate adjustment means according to the present invention;

FIG. 7 is a flow chart illustrating the procedure for establishing a desired horizontal spacing between the cutting blade and the pressure plate.

DETAILED DESCRIPTION OF THE PREFERRED EMBODIMENT

Figure 1:
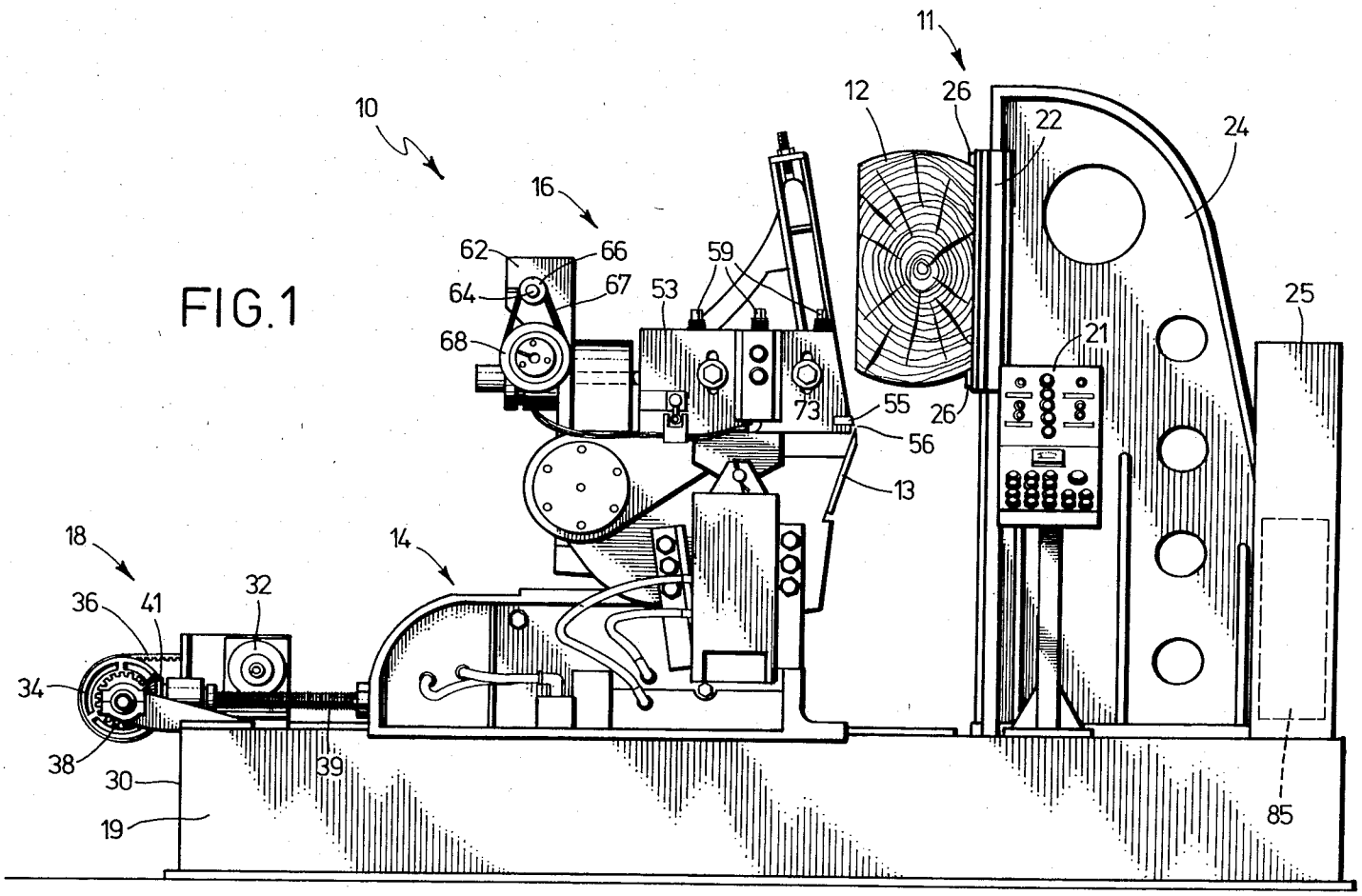
FIG. 1 is a side view of a veneer-slicing apparatus according to a preferred embodiment of the invention.
Figure 2:
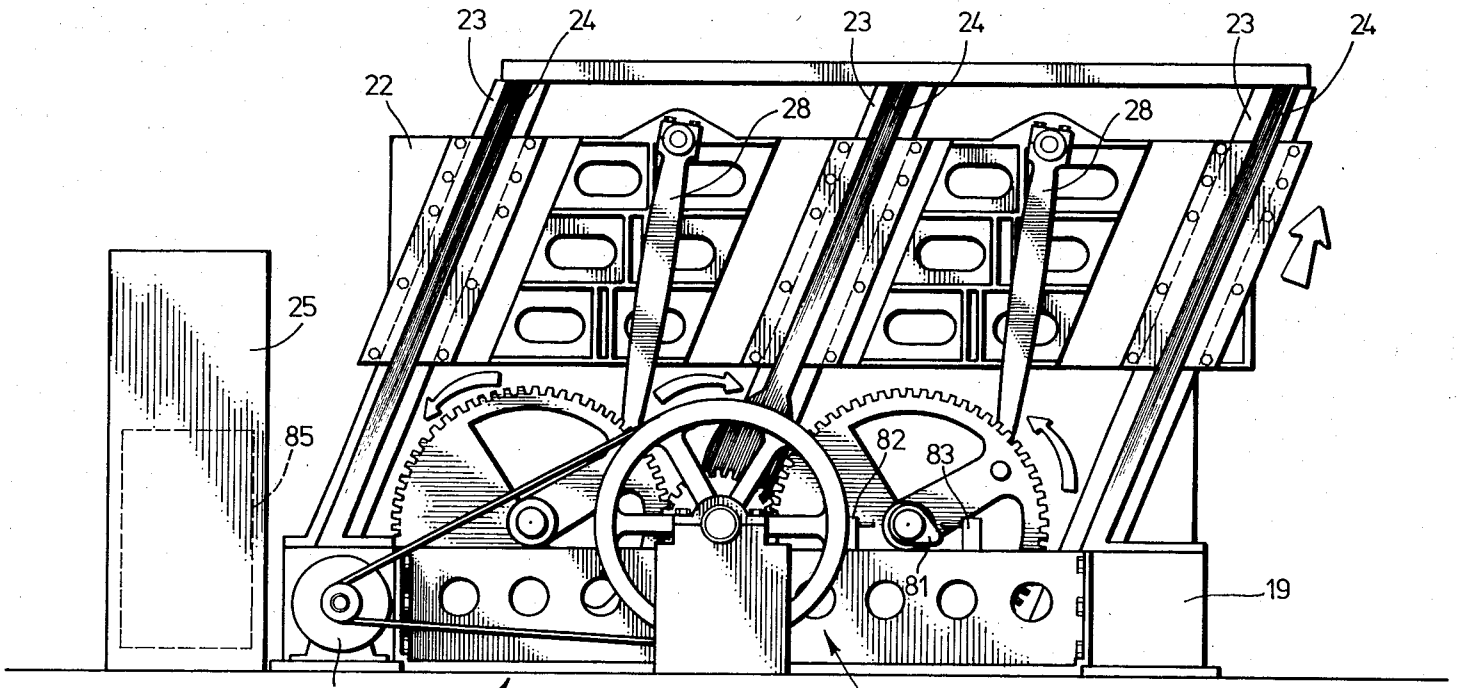
FIG. 2 is a view of the apparatus of FIG. 1 looking from the back side of the flitch table.

FIGS. 1 and 2 illustrate a veneer-slicing system according to a presently preferred embodiment of the invention. The system comprises a veneer-slicing machine 10 which includes a flitch support assembly 11 for supporting a log or log section 12, referred to as a flitch. The flitch support assembly 11 is vertically movable relative to a cutting blade 13 and in the system illustrated and described herein, is reciprocated such that thin veneer sheets can be sliced from the flitch during each downward stroke of the flitch. If desired, the system can also be designed to slice veneer sheets from the flitch during each upward stroke of the flitch.

Machine 10 also includes a carriage 14 which supports a pressure plate and cutting blade assembly 16. As will be explained in greater detail hereinafter, carriage 14 is horizontally movable toward and away from the flitch support assembly 11 during the operation of the machine. The carriage can position the cutting blade 13 adjacent to the flitch 12 to slice a veneer sheet from the flitch during the downward or slicing stroke of the flitch support assembly 11 and move it away from the flitch during the upward or return stroke of the flitch.

A flitch support assembly drive means 17 (FIG. 2) is provided for reciprocating the flitch 12, and a carriage drive means 18 is provided for moving the carriage 14.

Flitch support assembly 11, carriage 14, and the drive means 17 and 18 are all supported on a massive base or frame 19 which is preferably embedded within the floor of the factory. A control console 21 and an electrical control cabinet 25 are electrically coupled to the machine to control and monitor the operation of the machine.

Also included in the machine, but not illustrated in the Figs., is a sheet transport assembly for receiving the veneer sheets sliced from the flitch and for transferring the sheets to a location to be picked up and stacked by an operator for removal from the area.

Flitch support assembly 11 includes a flitch table 22 supported on a plurality of inclined guides 23 (FIG. 2) for reciprocating vertical movement along the guides. Guides 23 are supported by suitable standards 24. The flitch 12 is firmly mounted to the flitch table 22 by a plurality of dogs 26 as is well known in the art.

Flitch support assembly drive means 17 includes a flitch drive motor 27 which rapidly reciprocates the flitch table 22 up and down along guides 23 by connecting rods 28 connected to the motor by suitable gearing and belting generally designated by reference numeral 29 as is also known in the art. Motor 27 is preferably of the type which runs continuously and is coupled to the flitch table by an eddy current clutch that varies speed by varying the amount of slippage.

Carriage 14 is supported on base 19 on a pair of guides 31 (see FIG. 3) positioned on each side of the base and extending from adjacent end 30 of the base to approximately the flitch support assembly 11. Carriage 14 is adapted to be moved horizontally back and forth along the guides 31 by carriage drive means 18 to position the cutting blade 13 relative to the flitch 12 and to move it away from the flitch when necessary. Carriage drive means 18 includes a carriage drive motor 32 controlled from control console 21 via an electrical coupling (not shown).

Figure 3:
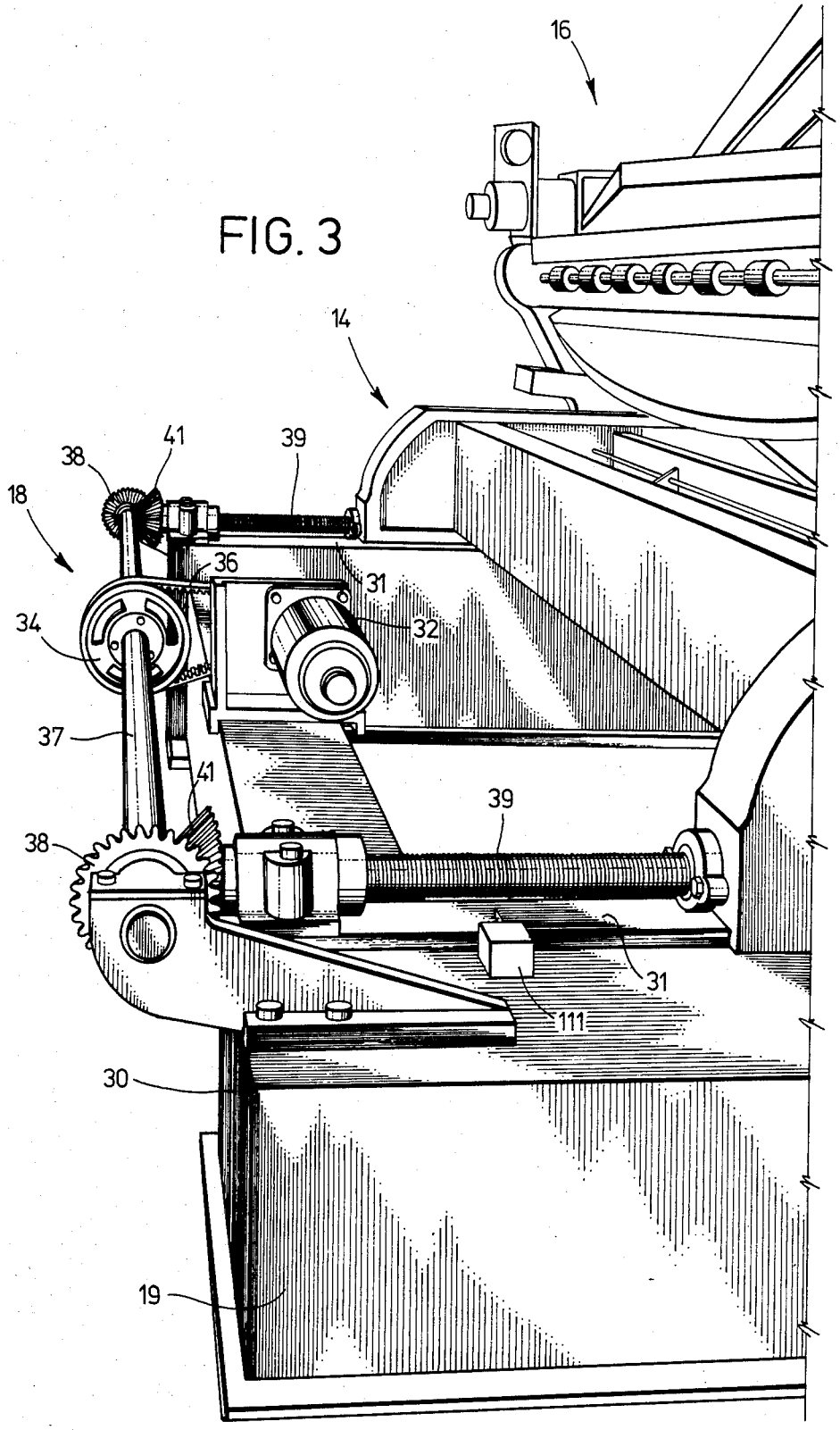
FIG. 3 is a perspective view of a portion of the apparatus of FIG. 1, illustrating the carriage drive means of the present invention.

As best shown in FIG. 3, drive motor 32 is connected to a wheel 34 by a drive belt 36; and wheel 34 is, in turn, mounted to a shaft 37 having a pair of gears 38 mounted on each end thereof. Carriage 14 is mounted on a pair of threaded shafts 39 having gears 41 mounted on the ends thereof which are adapted to mate with gears 38. With the above construction, actuation of carriage drive motor 32 will, via belt 36, wheel 34, shaft 37, gears 38, and gears 41, drive threaded shafts 39 into rotation, causing the carriage 14 to move forward or backward along the shafts 39, depending on whether the motor 32 is operating in the forward or reverse direction. Motor 32 is a DC direct drive motor manufactured by Kollmorgen Corporation, their Model No. TT-4503, and is capable of moving carriage 14 by very precise amounts of as little as 0.0001 inch. The new system of this invention can provide repeatable veneer thicknesses with an accuracy of ±0.001 inch.

Thus, in the present invention, the flitch support assembly 11 and the carriage 14 are driven independently of one another by separate drive means 17 and 18, respectively. This invention thus eliminates the mechanical linkage structure needed in prior systems to drive both components from the same drive means. Furthermore, as will be explained hereinafter, it provides substantially greater and more automated control over the movement of the carriage, permitting a number of advantageous features to be incorporated into the system.

Figure 4:
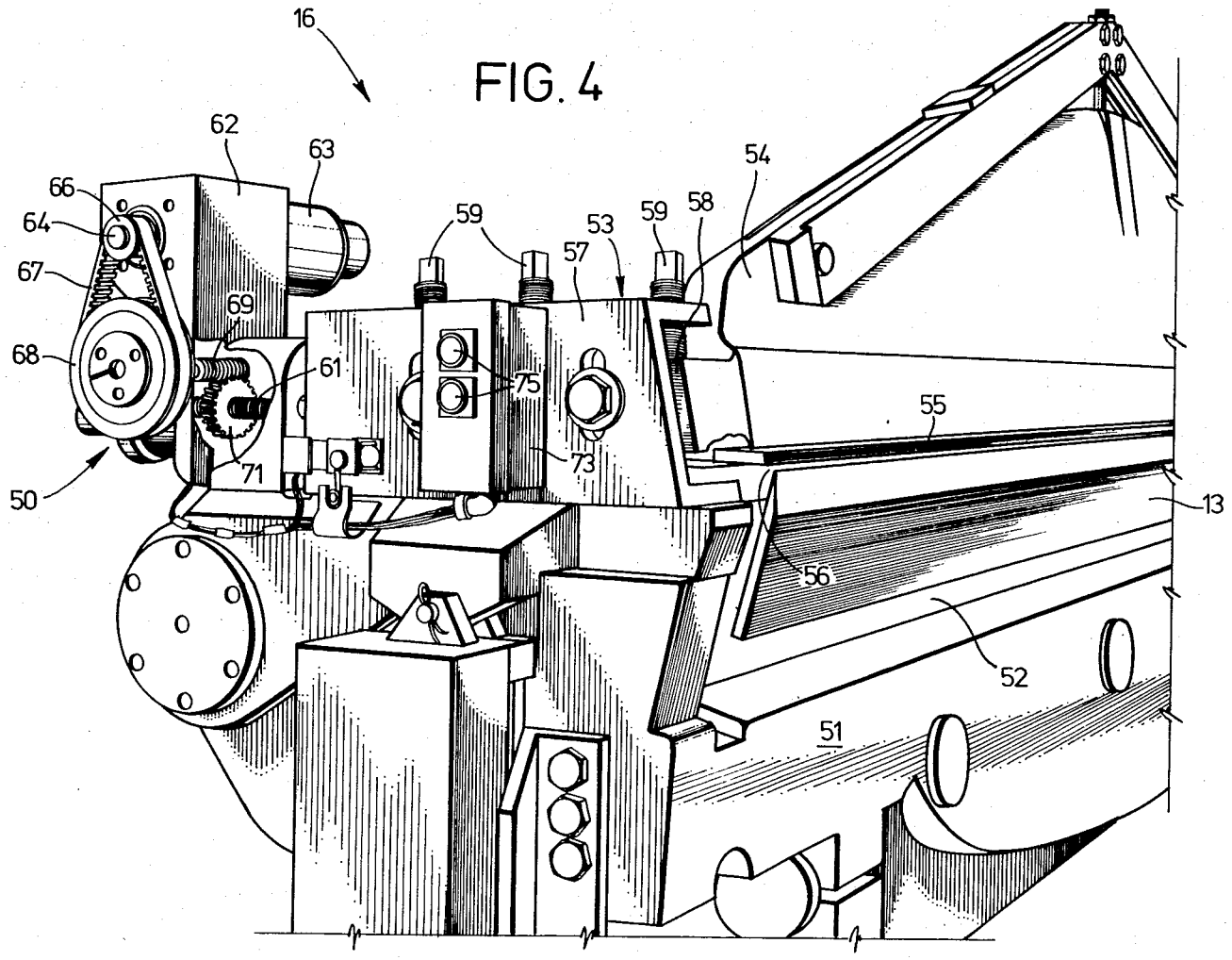
FIG. 4 is a perspective view of a portion of the apparatus of FIG. 1, illustrating the pressure plate and cutting blade assembly.

Supported on carriage 14 for movement therewith is pressure plate and cutting blade assembly 16. As illustrated most clearly in FIG. 4, this assembly includes a cutting blade support means 51, which has a surface 52 to which the cutting blade 13 is mounted, and a pressure plate support means 53 which includes a pressure plate mounting member 54 which supports a pressure plate 55. As shown in FIG. 4, cutting blade 13 and pressure plate 55 are several feet long (e.g., 8–20 feet) and extend substantially across the width of the machine and define between them a narrow space or blade opening 56.

During each downward stroke of flitch table 26, cutting blade 13 will slice a veneer sheet from the flitch; and the sheet will pass through space 56 to be received by a transport assembly, not shown, to be transferred to a location to be picked up by an operator. The pressure plate 55 provides support for the veneer sheet as it is being sliced; and in order to produce a high-quality sheet of uniform thickness, it must be accurately positioned with respect to the cutting edge of the blade. In particular, it must be positioned both vertically above and horizontally behind the cutting edge of the blade across the entire length of the blade.

In current systems, horizontal positioning of the pressure plate is accomplished by manually turning (with a wrench, for example) large feed screws threaded into each end of the pressure plate support means until each end of the pressure plate is properly spaced from the edge of the cutting blade. By the present invention, pressure plate adjustment means are provided at each end of the pressure plate to enable the pressure plate to be positioned more quickly and with greater accuracy than in current systems.

FIGS. 4 and 5 illustrate the pressure plate adjustment means 50 for adjusting one side of the pressure plate 55. Inasmuch as the pressure plate adjustment means on the opposite side of the pressure plate is identical in construction, no separate description is necessary.

As illustrated, pressure plate support means 53 includes a housing 57 within which is supported an integral flange or extended portion 58 of pressure plate mounting member 54. Flange 58 is movable vertically up or down within housing 57 by means of a plurality of screws 59 in order to correspondingly move the pressure plate 55 up or down to adjust the vertical spacing between the pressure plate 55 and the cutting blade 13. Typically, this vertical spacing would be set to about 0.03 inch or less. Screws 59 can also be used to adjust the angle of the pressure plate relative to the cutting blade, for example, by raising the forward end of flange 58 and lowering the rearward end of the flange.

In order to adjust the horizontal position of the pressure plate 55 relative to the edge of the cutting blade 13, housing 57 is mounted to the end of a feed screw 61.

Feed screw 61 extends into a housing 62 which supports an electric motor 63. Motor 63 is mechanically coupled to feed screw 61 by drive shaft 64, wheel 66 mounted to the end of drive shaft 64, timing belt 67 mechanically connecting wheel 66 to wheel 68, a worm gear 69 to which wheel 68 is mounted, and a gear 71 coupling worm 69 to feed screw 61. Gear 71 is internally threaded such that rotation of the gear by worm 69 will cause feed screw 61 to move forward or backward depending on the direction of rotation of the gear 71.

Motor 63 is a DC direct drive motor manufactured by Kollmorgen Corporation, their Model No. TT 2950 and is capable of a resolution of about 0.001 of a turn. Wheels 66 and 68 are sized to provide a 3:1 reduction between the rate of rotation of drive shaft 64 and worm 69, while feed screw 61 is provided with 100 turns per inch. Therefore, 300 turns of the motor 63 will move housing 57 and the pressure plate mounting member 54 supported thereby together with the pressure plate 55 mounted thereon a horizontal distance of one inch. Accordingly, the pressure plate adjustment means of the present invention is theoretically capable of moving the pressure plate forward or backward by a distance as small as about 0.000003 inch, although, in practice, movements of 0.001 inch have been found to be adequate.

The pressure plate adjustment means 50 on each end of the pressure plate are independently controlled by an electrical control 73 consisting of a series of push buttons 75 mounted on the end of each housing 57. By simply pressing the appropriate push button on control 73, the motor 63 can be pulsed to move one end of the pressure plate support means 53 and the pressure plate 55 mounted thereto backward or forward in very small incremental steps until that end of the pressure plate is precisely aligned in the same vertical plane as the edge of the cutting blade. Alignment can be determined by touch or by use of a hand-held gauge held against the cutting blade and pressure plate as is known in the field. The same procedure can then be repeated on the opposite end of the pressure plate.

Figure 6:
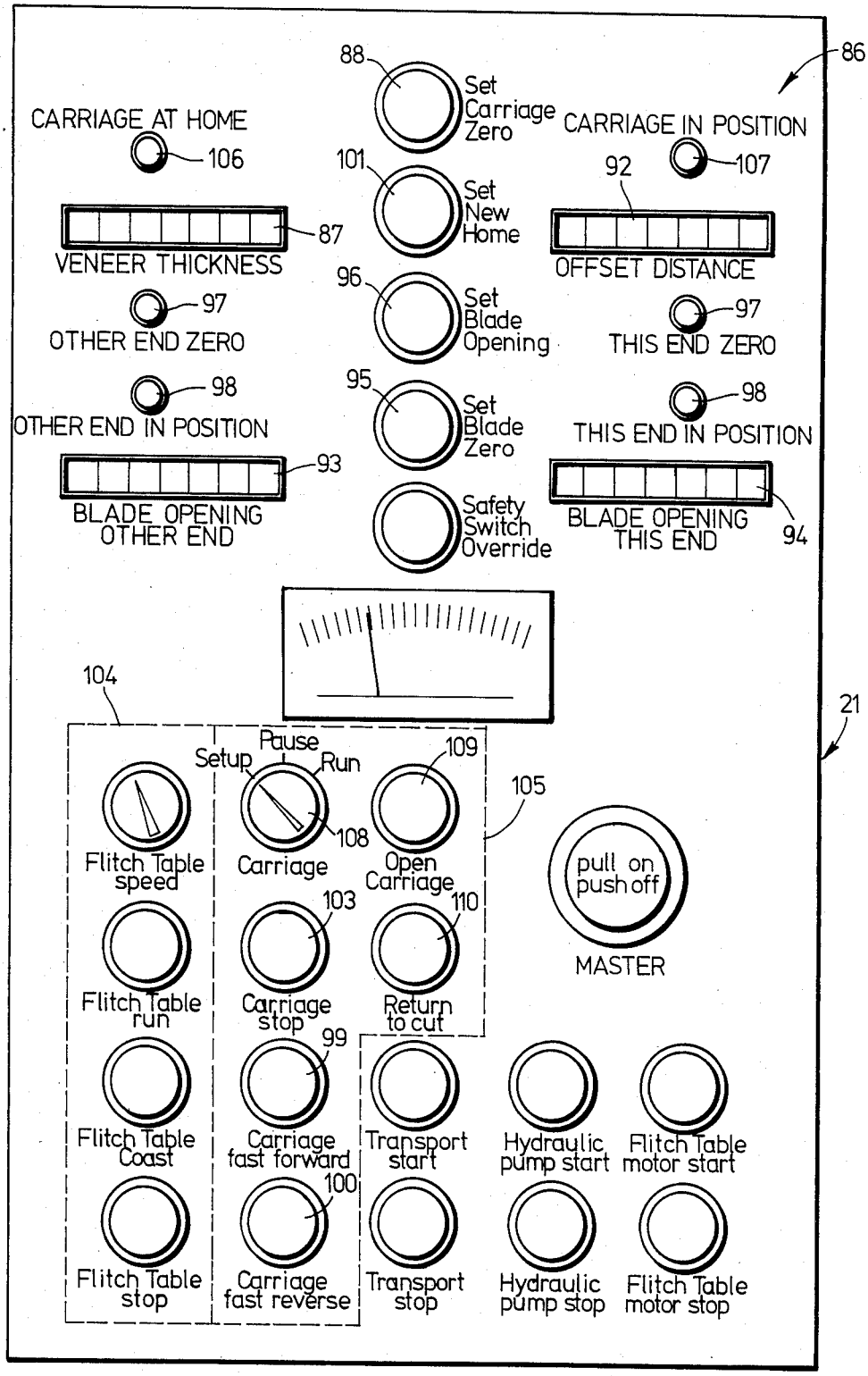
FIG. 6 illustrates the face of the central control console.

Once the pressure plate has been vertically aligned with the edge of the cutting blade, the horizontal spacing between the blade edge and the pressure plate can be obtained simply by setting the desired spacing for each side of the machine on thumbwheel switches 93 and 94 on central control console 21 (see FIG. 6). Computer means 85 within electrical control cabinet 25 will automatically actuate motors 63 on each end of the machine to move the pressure plate horizontally to the correct position to provide the desired spacing.

More particularly, FIG. 7 is a flow chart illustrating the procedure for establishing the desired horizontal spacing between the pressure plate and the cutting blade. Initially, as indicated above, the pressure plate and blade edge are positioned in vertical alignment or "zeroed" with respect to one another by use of the pushbuttons 75 on controls 73. Then "Set Blade Zero" button 95 on the central console is pressed to enter that setting into computer means 85. The desired blade horizontal openings are then set by thumb-wheel switches 93 and 94 and "SET BLADE OPENING" button 96 is depressed to enter the desired openings into the computer means which then actuates motors 63 on either side of the machine to automatically position the pressure plates. Indicator lights 97 and 98 are provided on console 21 to indicate proper entry of the pressure plate zero position into computer means 85 and when the pressure plate is positioned at the desired spacing, respectively. As a safety feature, control 73 and "Set Blade Zero" button 95 on console 21 is only active when switch 108 on the console (see FIG. 6) is in the "SETUP" position.

Typically, the horizontal blade-pressure plate spacing is set to be ten percent less than the desired veneer thickness. This results in the veneer sheets being compressed somewhat as they pass through blade opening 56 which has been found to improve the quality of the veneer sheet.

Thus, with the present invention, horizontal adjustment of the pressure plate relative to the cutting blade requires only that a series of buttons be pressed to move the pressure plate in very small increments to vertically align the blade edge with the pressure plate, and, thereafter, that the desired spacing be set on the control console. The present invention, accordingly, permits the adjustment to be made more quickly and with greater accuracy than in current systems; and since the alignment must usually be performed at the beginning of each work day or whenever the cutting blade is replaced, this is a significant capability.

As indicated previously, during each downward stroke of flitch table 26, cutting blade 13 will slice a veneer sheet from the flitch. Following each downward stroke, the flitch table is then returned to its uppermost position in preparation for slicing the next sheet. Prior to each upward stroke of the flitch table, it is necessary to move the cutting blade back and away from the flitch so that it will not be contacted and possibly damaged by the flitch during its upward movement. In current systems, this is done by mounting the pressure plate and cutting blade assembly on ball joints and pivoting the assembly back out of the way during each upward stroke of the flitch table.

Prior to the initiation of each downward slicing stroke of the flitch table, it is also necessary to index the cutting blade toward the flitch table by a distance equal to the thickness of the veneer sheets being sliced from the flitch (e.g., 0.02 inch) to maintain the blade properly positioned relative to the flitch. In current systems, this is accomplished by moving the carriage upon which the pressure plate and cutting blade assembly is mounted toward the flitch plate after each reciprocation of the flitch plate through a complex series of gears and other mechanical components connected to the flitch drive motor 27.

According to the present invention, means are provided for controlling the movement of both the pressure plate and cutting blade assembly and the carriage which is more efficient and versatile than in current systems.

Specifically, and as described previously, carriage 14 is moved horizontally back and forth along guides 31 by a carriage drive means 18 which is totally separate from and independent of the flitch support assembly drive means 17. Furthermore, the pressure plate and cutting blade assembly 16 is rigidly mounted on the carriage; and the cutting blade 13 is moved back out of the path of the upwardly moving flitch 12 by moving the entire carriage 14 back and away from the flitch.

In operation of the system of the present invention, prior to each upward return stroke of the flitch table, carriage drive motor 32 is actuated to move the carriage 14 and the pressure plate and cutting blade assembly mounted thereon rearwardly away from the flitch table 22 by a first distance, for example, of about 0.01 inch, sufficient to insure that the returning flitch will not contact the cutting blade. Prior to each downward slicing stroke of the flitch table 22, carriage drive motor 32 will be reversed and move the carriage forwardly toward the flitch table by a second distance equal to the first distance plus an additional distance equal to the thickness of the veneer sheets being sliced from the flitch 12. This will properly position the cutting blade 13 relative to the flitch 12 to slice the next sheet from the flitch during the next downward stroke of the flitch table.

In order to control the actuation of carriage drive motor 32 to move the carriage 14 backward and forward at the proper times during each cycle of the reciprocating flitch table 22, a suitably shaped cam means 81 is mounted to an oscillating component of the flitch support assembly drive means 17, as illustrated in FIG. 2. Limit switches 82 and 83 are mounted adjacent to the cam means 81 and are positioned to be actuated by the oscillating cam means 81 just after the flitch 12 clears the cutting blade 13 during the downward stroke of the flitch table, and just after the flitch clears the cutting blade during its upward stroke, respectively. Actuation of the switch 82 will, through an appropriate electrical connection, not shown, cause actuation of carriage motor 32 to move the carriage rearwardly away from the flitch table 22 while actuation of switch 83 will actuate carriage motor 32 to move the carriage forwardly toward the flitch table. It is preferable to position the switches 82 and 83 to actuate the carriage motor 32 just after the flitch clears the cutting blade during its downward and upward stroke, respectively, rather than when the flitch table actually reaches the bottom or top of its stroke, as this provides additional time for the carriage to move back and forth during each reciprocation permitting smoother operation of the machine.

The extent of movement of the carriage 14, as well as a number of other operating parameters of the veneer-slicing system, is monitored and controlled from central console 21. Console 21 comprises a control panel 86 which includes a plurality of controls and indicators which control and monitor the system through computer means 85, preferably comprising a plurality of microprocessor circuits, supported within the electrical control cabinet 25.

FIG. 6 illustrates the control panel 86 on console 21. As shown, the panel includes a thumbwheel setting means 87 for setting the desired thickness of the veneer sheets to be sliced from the flitch 12. By setting switch 87, carriage motor 32 will be automatically controlled by the microprocessors to move the carriage 14 forwardly (following each rearward movement of the carriage by a first distance to clear the cutting blade from the upwardly moving flitch) by a second distance equal to the first distance plus a distance equal to the selected veneer thickness. This is accomplished as follows: Initially, the carriage 14 is set at a zero position relative to the flitch prior to the initiation of a slicing operation. This zero position is established and stored in the microprocessor by depressing "SET CARRIAGE ZERO" button 88 with the "CARRIAGE SETUP-PAUSE-RUN" switch 108 set at its "SETUP" position. This causes the carriage 14 to move in a rearward direction until it finds and actuates "AT HOME" limit switch 111 that is illustrated in FIG. 3. If carriage 14 was holding "AT HOME" limit switch 111 actuated when the system was first turned on, then computer means 85 causes carriage 14 to move forward away from "AT HOME" limit switch 111 so that the home position is established and stored with the carriage 14 moving at the same speed and in the same direction every time "Home" is established. This is necessary because limit switch 111 will remain actuated over a long distance even if carriage 14 had been moved by some external force with power to the system disconnected.

As a further protective feature, the computer means 85 prevents any operation of the carriage feed or blade opening systems it controls until the carriage home position has been established and stored.

The system also includes the capability of setting an "AT HOME" position different than that which is established and stored in computer means 85 by the "AT HOME" limit switch 111. Specifically, on occasion, for example, when all of the flitches to be sliced are relatively small, it may not be necessary to open the carriage fully to its "AT HOME" limit switch 111 position to load a flitch or service the machine. Instead, it may be sufficient to open the carriage only slightly more than the width of the largest flitch contemplated so that the system can be more rapidly returned to operative status. Thus, a different home position can be established by moving the carriage 14 closer to flitch table 26 than where you would like for the new home position to be using the "CARRIAGE FAST-FORWARD" button 99 with the "CARRIAGE SETUP-PAUSE-RUN" switch 108 set at its "PAUSE" position. Switch 108 is then reset to its "SETUP" position and the "SET CARRIAGE ZERO" button 88 is pressed. This causes the computer means 85 to move carriage 14 in a rearward direction hunting for the "AT HOME" limit switch 111. When carriage 14 reaches the opening size desired, the "SET NEW HOME" button 101 is pressed by the operator; and the current position of carriage 14 is stored in the microprocessor memory as the "Home" position. Thus, the operator can stop the feeding action of the machine by resetting the "CARRIAGE SETUP-PAUSE-RUN" switch 108 from "RUN" to "PAUSE" and then can cause computer means 85 to drive carriage 14 to its "Home" position by pressing "OPEN CARRIAGE" button 109 no matter whether "Home" is at limit switch 111 position or at some other "Home" position. As a further aspect of the invention, once the carriage 14 has been sent to its "Home" position for servicing by pressing "OPEN CARRIAGE" button 109, then computer means 85 will be caused to drive carriage 14 to its previous position simply by pressing "RETURN TO CUT" button 110. Thus, restarting the slicing operation is accomplished much faster than in current systems.

As illustrated in FIG. 6, control panel 86 includes "CARRIAGE FAST-FORWARD" button 99 and "CARRIAGE FAST-REVERSE" button 100 which can be utilized when the "CARRIAGE SETUP-PAUSE-RUN" switch 108 is set to its "PAUSE" position to move the carriage 14 to some position other than its "Home" position. A primary usage of these switches is to position the carriage close to the face of a new flitch that has just been loaded onto flitch table 26 since computer means 85 does not know where to position the carriage until some slicing of the flitch as been done.

As shown in FIG. 6, the control panel 86 also includes a number of other controls and indicators. These include several flitch table controls 104; several carriage controls 105; various monitors 97, 98, 106, and 107; and various other controls. Their presence at one location on the control panel makes the overall control of the system easier and more convenient to the operator. Thumbwheel switch 92 is also incorporated into the console to set the offset (the rearward movement or the "first distance") described above. If the machine operator prefers to utilize the current system for offsetting the knife and pressure plate away from the flitch being sliced during the upstroke of the flitch table, then this switch need not be included in the system; or if it is included, it can be not utilized by setting all digits on the switch to "zero".

The specific construction of the computer means 85 does not form a part of the present invention and, accordingly, is not described in detail herein. The microprocessor circuitry used in the preferred embodiment includes those incorporated into servomotor control systems sold by Industrial Indexing Systems, Inc., 626 Fishers Run, Victor, N.Y.

While what has been described constitutes a presently most preferred embodiment of the invention, it should be understood that the invention could take various other forms. Accordingly, it should be understood that the invention should be limited only insofar as is required by the scope of the following claims.

I claim:

1. Veneer-slicing apparatus, comprising:

a flitch table for supporting a flitch to be sliced;

a carriage;

a cutting blade mounted on said carriage for slicing veneer sheets from said flitch;

first drive means for reciprocating said flitch table and said flitch supported thereon in a first plane, each reciprocation of said flitch table including a slicing stroke and a return stroke;

second drive means for moving said carriage and said cutting blade mounted thereon in a second plane substantially perpendicular to said first plane, said second drive means includes means for moving said carriage and said cutting blade mounted thereon in a forward direction toward said flitch table prior to said slicing stroke for placing said cutting blade in position to slice a veneer sheet from said flitch during said slicing stroke, and for moving said carriage and said cutting blade mounted thereon in a rearward direction away from said flitch table and out of the path of said flitch prior to said return stroke, said first and second drive means including first and second drive motors for independently reciprocating said flitch table and moving said carriage, respectively; and control means coupled to said second drive means for moving said carriage a first distance in said reverse direction and for moving said carriage a second distance in said forward direction, said second distance being equal to said first distance plus a distance equal to the desired thickness of the veneer sheet to be sliced from said flitch, said control means including means for setting the desired thickness of said veneer sheet to be sliced from said flitch, and means for determining the correct second distance in said forward direction to obtain veneer sheets of said desired thickness.

2. Apparatus as recited in claim 1 wherein said means for determining said correct second distance includes computer means for controlling said second drive means.

3. Apparatus as recited in claim 2 wherein said control means includes a control console, and wherein said means for setting the desired thickness of said veneer sheet comprises veneer thickness setting means positioned on said console.

4. Apparatus as recited in claim 3 wherein said veneer thickness setting means comprises thumbwheel setting means.

5. Apparatus as recited in claim 3 wherein said control means further includes means on said console for setting said first distance.

6. Apparatus as recited in claim 3 wherein said control means further includes means on said console for moving said carriage in said forward and reverse directions at an increased rate of speed.

7. Apparatus as recited in claim 2 wherein said computer means includes means for storing data representing the position of said carriage, and means coupled to said second drive means for returning said carriage to the correct position to restart a slicing operation following a stoppage of the slicing operation for servicing or the like.

8. Veneer-slicing apparatus, comprising:

means for supporting a flitch to be sliced;

a pressure plate and cutting blade assembly, said pressure plate and cutting blade assembly including pressure plate means and cutting blade means defining a space therebetween for receipt of veneer sheets sliced from said flitch;

means for causing relative movement between said flitch and said cutting blade means for slicing veneer sheets from said flitch; and pressure plate adjustment means for positioning said pressure plate means with respect to said cutting blade means, said pressure plate adjustment means including first electric drive means, means coupling said electric drive means to said pressure plate means, first control means for actuating said electric drive means to move said pressure plate means horizontally relative to said cutting blade means for vertically aligning said pressure plate means with said cutting blade means, and second control means for actuating said electric drive means to move said pressure plate means horizontally for achieving a desired horizontal spacing between said pressure plate means and said cutting blade means.

9. Apparatus as recited in claim 8 wherein said coupling means includes feed screw means coupled to said pressure plate means whereby rotation of said feed screw means causes horizontal movement of said pressure plate means; and means for coupling said electric drive means to said feed screw means.

10. Apparatus as recited in claim 9 wherein said electric drive means comprises DC direct drive electric motor means.

11. Apparatus as recited in claim 10 wherein said means for coupling said electric drive means to said feed screw means includes timing belt means for reducing the rate of rotation of said feed screw means relative to the rate of rotation of aid DC direct drive electric motor means.

12. Apparatus as recited in claim 8 wherein said first control means includes push-button control means.

13. Apparatus as recited in claim 8 wherein said second control means comprises means for setting said desired horizontal spacing, and computer means for actuating said electric drive means for achieving said desired horizontal spacing.

14. Apparatus as recited in claim 13 wherein said setting means comprises thumbwheel switches.

15. Apparatus as recited in claim 14 and further including a central console, said thumbwheel switches being positioned on said control console.

16. Apparatus as recited in claim 8 wherein said pressure plate adjustment means comprises two pressure plate adjustment means, one positioned at each end of said pressure plate means, and wherein the first control means of each of said two pressure plate adjustment means is positioned adjacent its associated pressure plate adjustment means.

17. Apparatus as recited in claim 16 wherein each of said first control means comprises pushbutton control means.

18. Veneer-slicing apparatus, comprising:

a reciprocating flitch table for supporting a flitch to be sliced;

cutting blade means for slicing veneer sheets from said flitch;

drive means for relatively moving said cutting blade means and said flitch table in a direction toward one another following the slicing of a veneer sheet from said flitch for repositioning said cutting means relative to said flitch for slicing a subsequent veneer sheet from said flitch; and control means for controlling said drive means, said control means including:

a control console;

means on said control console for setting the desired thickness of said veneer sheets to be sliced from said flitch; and means coupling said control console to said drive means for relatively moving said cutting means and said flitch table toward one another by a distance necessary to obtain sliced veneer sheets of said desired thickness.

19. Apparatus as recited in claim 18 wherein said setting means comprises thumbwheel setting means.

20. Apparatus as recited in claim 18 wherein said coupling means includes computer means for controlling said drive means.

21. Apparatus as recited in claim 20 wherein each reciprocation of said flitch table includes a slicing stroke and a return stroke, and wherein said drive means includes means for moving said cutting blade means in a forward direction toward said flitch prior to each slicing stroke for placing said cutting blade means in position to slice veneer sheets from said flitch during each slicing stroke, and for moving said cutting blade means in a rearward direction away from said flitch and out of the path of said flitch prior to said return stroke.

22. Apparatus as recited in claim 21 wherein said control means includes means for moving said cutting blade means a first distance in said reverse direction and wherein said computer means includes means for determining a second distance in said forward direction, said second distance being equal to said first distance plus a distance equal to the desired thickness of said veneer sheets to be sliced set on said setting means.

23. Apparatus as recited in claim 18 wherein said control console further includes means for relatively moving said flitch table and said cutting blade means toward and away from one another at an increased rate of speed.

24. Apparatus as recited in claim 22 wherein said computer means includes means for storing data representing the position of said cutting blade means, and wherein said coupling means includes means for moving said cutting blade means in said forward direction to the correct position to restart a slicing operation following a stoppage of said slicing operation and the movement of said cutting blade means in said reverse direction for servicing or the like.

25. In a veneer slicing machine, a method for horizontally positioning a pressure plate and a cutting blade with respect to one another for defining a desired horizontal space therebetween for receipt of a veneer sheet sliced from a flitch, said method comprising:

vertically aligning said pressure plate and cutting blade;

entering said vertically aligned position into computer means;

entering the desired horizontal spacing into said computer means; and actuating said machine for automatically positioning said pressure plate and cutting blade in the desired horizontal position relative to one another.

26. A method as recited in claim 25 wherein said step of entering the desired horizontal spacing into said computer means includes setting the desired horizontal spacing on a central console.

27. A method as recited in claim 26 wherein said setting step comprises setting thumbwheel switches on said central console.

28. Veneer-slicing apparatus, comprising:

a flitch table for supporting a flitch to be sliced;

a carriage;

a cutting blade mounted on said carriage for slicing veneer sheets from said flitch;

a drive means for reciprocating said flitch table and said flitch supported thereon in a first plane, each reciprocation of said flitch table including a slicing stroke and a return stroke;

an independent motor for moving said carriage and said cutting blade mounted thereon in a second plante substantially perpendicular to said first plane, said independent motor being controllable for moving said carriage and said cutting blade mounted thereon in a forward direction toward said flitch table prior to said slicing stroke to position said cutting blade to slice a veneer sheet from said flitch during said slicing stroke and for moving said carriage and said cutting blade mounted thereon in a rearward direction away from said flitch table and out of the path of said flitch prior to the return stroke; and means coupled to said first drive means for actuating said independent motor to move said carriage in the forward and rearward directions at the desired times during the reciprocation of said flitch table.

29. Apparatus as recited in claim 28 wherein said means coupled to said first drive means comprises cam means connected to said first drive means, and switch means enabled by said cam means to actuate said independent motor to move said carriage in said forward and reverse directions.

30. The apparatus of claim 28 wherein said carriage is engaged by two threaded shafts, one threaded shaft being engaged with the carriage at each of its ends, said threaded shafts and carriage being adapted so that rotation of the threaded shafts will move the carriage in the second plane, and wherein said independent motor is mechanically coupled to a shaft that is adapted to rotate said threaded shafts so that rotation of said independent motor will move said carriage by directly driving it with said threaded shafts at each of its ends.

31. The apparatus of claim 28 wherein said apparatus includes a control means permitting direct entry of the veneer thickness desired and operation of said independent motor to move the carriage in a rearward direction a distance sufficient to clear the flitch on the return stroke and in a forward direction a distance sufficient to position the cutting blade to slice a veneer sheet of the desired thickness during the slicing stroke.

32. The apparatus of claim 31 wherein said control means include means for storing data on the position of said carriage so that in the event of an interruption of the slicing operation, the carriage may be moved rearwardly and upon the resumption of operation the carriage may be properly repositioned by moving the carriage forwardly.

33. The apparatus of claim 32 wherein said apparatus includes a control means permitting movement of said carriage at a increased rate of speed.

34. Veneer-slicing apparatus, comprising:

a flitch table for supporting a flitch to be sliced;

a carriage;

a cutting blade mounted on said carriage for slicing veneer sheets from said flitch;

pressure plate means mounted on said carriage adjacent said cutting blade, said pressure plate means and said cutting blade defining a space therebetween for receiving veneer sheets sliced by said cutting blade;

pressure plate adjustment means on each end of said pressure plate means for positioning said pressure plate means relative to the edge of said cutting blade, each of said pressure plate adjustment means including electric drive means, means coupling said electric drive means to said pressure plate means, and electric drive control means coupled to said electric drive means for actuating said electric drive means to move said pressure plate means relative to said cutting blade for positioning said pressure plate relative to said edge of said cutting blade;

first drive means for reciprocating said flitch table and said flitch supported thereon in a first plane; and second drive means for moving said carriage and said cutting blade and pressure plate means mounted thereon in a second plane substantially perpendicular to said first plane, said first and second drive means including first and second drive motors for independently reciprocating said flitch table and moving said carriage, respectively.

35. Apparatus as recited in claim 34 wherein said coupling means includes feed screw means coupled to said pressure plate means whereby rotation of said feed screw means causes lateral movement of said pressure plate means, and means for coupling said electric drive means to said feed screw means.

36. Apparatus as recited in claim 35 wherein said electric drive means comprises a DC direct drive electric motor means.

37. Apparatus as recited in claim 36 wherein said means for coupling said electric drive means to said feed screw includes timing belt means for reducing the rate of rotation of said feed screw relative to the rate of rotation of said DC direct drive electric motor means.

38. Apparatus as recited in claim 36 wherein said electric drive control means includes push-button control means positioned adjacent each said pressure plate adjustment means.

39. Apparatus as recited in claim 34 wherein said electric drive control means comprises means for actuating said electric drive means to vertically align said pressure plate means relative to said edge of said cutting blade, and wherein said apparatus further includes means for selecting the desired horizontal spacing between said pressure plate means and said edge of said cutting blade, and computer means for actuating said electric drive means to move said pressure plate means horizontally relative to said edge of said cutting blade by a distance to obtain said desired horizontal spacing.

40. Apparatus aa recited in claim 39 wherein said selecting means comprises thumbwheel switch means.

41. Apparatus as recited in claim 1 wherein said first plane comprises a substantially vertical plane and said second plane comprises a substantially horizontal plane, and wherein said slicing stroke comprises a downward stroke and said return stroke comprises an upward stroke.

* * * * *

UNITED STATES PATENT AND TRADEMARK OFFICE

CERTIFICATE OF CORRECTION

PATENT NO. : 4,601,317

DATED : July 22, 1986

INVENTOR(S) : Robert D. Brand

It is certified that error appears in the above-identified patent and that said Letters Patent is hereby corrected as shown below:

In col. 13, line 56 (claim 28, line 12), delete "plante" and insert --plane-- therefor.

In col. 16, line 12, (claim 40, line 1), delete "aa" and insert --as-- therefor.

Signed and Sealed this

Fourteenth Day of October, 1986

[SEAL]

*Attest:*

DONALD J. QUIGG

*Attesting Officer*

*Commissioner of Patents and Trademarks*